United States Patent [19]

Todd

[11] 4,084,639

[45] Apr. 18, 1978

[54] ELECTRODE WELL FOR ELECTRICALLY HEATING A SUBTERRANEAN FORMATION

[75] Inventor: John C. Todd, Dallas, Tex.

[73] Assignees: Petro Canada Exploration Inc.; Canada-Cities Services, Ltd.; Imperial Oil Limited, all of Canada

[21] Appl. No.: 751,057

[22] Filed: Dec. 16, 1976

[51] Int. Cl.[2] ..... E21B 43/25

[52] U.S. Cl. ..... 166/248; 52/160; 174/6; 174/7

[58] Field of Search ..... 166/248, 65 R; 175/77, 175/379; 52/160; 174/6, 7

[56] References Cited

U.S. PATENT DOCUMENTS

| | | | |
|---|---|---|---|
| 2,044,648 | 6/1936 | Stevens | 175/77 X |
| 2,068,545 | 1/1937 | Haig | 174/7 |
| 3,149,672 | 9/1964 | Orkiszewski et al. | 166/248 |
| 3,526,069 | 9/1970 | Deike | 52/160 |
| 3,680,274 | 8/1972 | Deike | 52/160 X |

FOREIGN PATENT DOCUMENTS

| | | | |
|---|---|---|---|
| 262,281 | 12/1926 | United Kingdom | 174/7 |

*Primary Examiner*—Ernest R. Purser

*Attorney, Agent, or Firm*—Hubbard, Thurman, Turner, Tucker and Glaser

[57] ABSTRACT

An improved electrode for electrically heating a subterranean formation includes a plurality of electrically conductive rod-like members that extend outwardly from a central well bore to provide increased area for conducting electrical current from a source into said subterranean formation. The improved electrode apparatus is adapted to be lowered into a well bore which has been drilled into the subterranean formation and, thereafter, the plurality of rod-like members are driven outwardly from the central well bore. Guide means are provided to direct the rod-like members outwardly into the subterranean formation as a central member is forced downwardly.

6 Claims, 5 Drawing Figures

ELECTRODE WELL FOR ELECTRICALLY HEATING A SUBTERRANEAN FORMATION

BACKGROUND OF THE INVENTION

This method relates to an improved electrode apparatus and method for electrically heating a subterranean formation. In another aspect, this invention relates to an improved electrode apparatus and method for conducting electric current into a subterranean formation with improved and increased contact between the conducting elements and the subterranean formation. In still another aspect, this invention relates to an improved method and apparatus for uniformly heating a subterranean formation by passing an electric current through said formation between spaced-apart electrode means.

For many years, it has been known that large deposits of very viscous material, such as tar, heavy crude oil, and the like, are present in subterranean formations. Because of the high viscosity of some of these materials, various methods for heating them in situ to lower their viscosity, have been suggested. By lowering the viscosity of such materials as tar, which can be found in large deposits of subterranean tar sands, the materials can be produced through production wells by means of injecting certain driving fluids as steam, hot water, hot gases and the like. Normally, in order to carry out such a production technique, it is necessary to first heat at least a portion of the subterranean formation to lower the viscosity of the viscous material to a point where the driving fluid can initiate flow of the material from the subterranean formation.

Recently, techniques have been utilized that incorporate the use of electric currents to pass through the subterranean formation. As the electric currents pass through the subterranean formations, the inherent resistance of the formations will cause the formations to heat up and thereby lower the viscosity of the viscous materials contained therein.

Since the discovery of the method of passing electric currents through the subterranean formations to lower the viscosity of the materials contained therein, a considerable amount of activity has been devoted to developing techniques using this basic process. For example, process and apparatus using this basic discovery have been disclosed in U.S. Pat. Nos. 3,642,066, issued Feb. 15, 1972; 3,874,450, issued Apr. 1, 1975; 3,848,671, issued Nov. 19, 1974; 3,948,319, issued Apr. 6, 1976; and 3,958,636, issued May 25, 1976, all of which Patents are hereby incorporated by reference.

While the foregoing patents represent only a few of the techniques that utilize electrodes for passing current therebetween to heat subterranean formations in situ, these patents and various others all recognize certain problems and dificulties in evenly conducting electricity through such subterranean formations. For example, most of the references acknowledge the fact that large amounts of current must be passed through the subterranean formations in order to achieve the desired heating. With the passage of large amounts of current through such formations, it is also recognized that the portions of the subterranean formations immediately adjacent the electrodes experience the greatest current densities. As the current density or the amount of current flowing through a given area is increased, a problem of overheating in the general area is experienced. The overheating problem becomes so severe in some cases that it will dry out or vaporize electrolyte materials in the general vicinity of the electrodes, thus causing an interruption or decrease in the amount of current that flows through the subterranean foundations. Additionally, the excessive heat will often be so great as to melt or otherwise damage the electrode members. It is further recognized in the prior art that it is often difficult to obtain a good, conductive contact between the electrode members placed in electrode wells and the surrounding subterranean formation that is to be heated.

In view of the foregoing problems and deficiencies of prior art methods and apparatus for passing current through subterranean formations, it is, of course, highly desirable to develop improved methods and apparatus for such use.

SUMMARY OF THE INVENTION

Accordingly, it is an object of this invention to provide an improved method and apparatus for passing current through subterranean formations. It is another object of this invention to provide an improved method and apparatus for evenly distributing electric current through a subterranean formation without overheating portions of the subterranean formation. It is yet another object of this invention to provide an improved method and apparatus for heating subterranean formations by passing electric current between improved electrode means. It is still another object of this invention to provide improved removal of heat from the area where large amounts of current are flowing in the vicinity of an electrode means.

Other aspects, objects and advantages of this invention will be apparent to those skilled in the art from the following disclosure and appended claims. The instant invention utilizes an improved electrode means that comprises a plurality of rod-like members that are forced outwardly into contact with a subterranean formation with the rod-like members extending outwardly away from a central well bore which has been drilled into the subterranean formation. The apparatus includes deformable, or bendable, rod-like members that can be forced outwardly into the subterranean formation away from a central well bore by forcing the lower ends of said rod-like members downwardly across a deflector member that directs the rod-like members in an outward direction from the central well bore. By utilizing an outer casing with a movable inner pipe string of a smaller diameter, the bendable rod-like members can be placed in the annular space between the outer casing and the inner pipe string. The deflector member can be placed below the end of the outer casing and by applying force to the upper ends of the rod-like members, they can be forced downwardly into contact with the deflector and will be deflected outwardly and away from the central well bore. Continued force applied to the upper ends of the bendable, rod-like members will cause them to be driven into the subterranean formation as they travel outwardly away from the central well bore. By utilizing a plurality of the rod-like members and constructing them of an electrically conductive material, the effective surface area of the rod-like members in contact with the subterranean formation will be quite large and will serve as an enlarged electrode means when the voltage is applied across it and another spaced-apart electrode means. By utilizing the enlarged surface area and enlarged contact area between the conductive rod-like members and the subterranean formation, large quantities of electric current can be passed through the improved electrode means without unnecessarily high current densities which wuld normally result in overheating of localized portions of the subterranean formation. In some instances, a plurality of the rod-like members can be disposed at varying depths through the subterranean formation to further increase the electrode surface and contact surface between the electrode and the subterranean formation.

DESCRIPTION OF PREFERRED EMBODIMENTS

Figure 1:
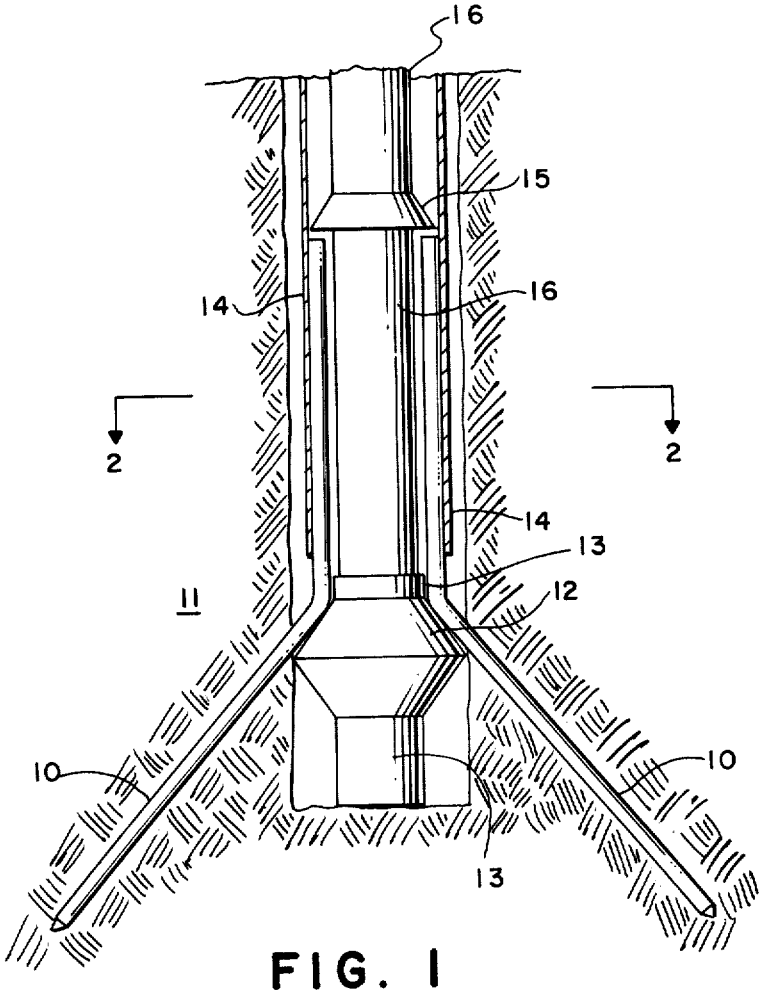
FIG. 1 is an elevational view of one of the preferred embodiments of this invention as it is installed in a subterranean formation with a portion of the outer casing in sectional view to expose the rod-like elements and other elements utilized to drive the rods into contact with the subterranean foundation.

The preferred embodiments and advantages of this invention can best be described by referring to the drawings. In FIG. 1, a plurality of electrically conductive rod-like members 10 extend radially outwardly from the central well bore. The rod-like members 10 are driven into subterranean formation 11 by means of a force applied to the upper ends thereof such that they are forced downwardly into contact with deflector collar 12 which is carried by base pipe 13. Base pipe 13 can either rest on the bottom portion of the bore hole or it can be cemented into place. Outer casing 14 is a large diameter pipe that is lowered into the well bore so as to form an annular space between outer casing 14 and pipe string 16. A plurality of rod-like members 10 are placed in the annular space as is more clearly illustrated by FIG. 2. The lower end of outer casing 14 terminates at a point above deflector collar 12 at a distance sufficient to allow rod-like members 10 to be forced downwardly into contact with deflector collar 12 and, as force is applied to the upper ends of rod-like members 10 to allow the rod-like members to bend away from the upper end of base pipe 13 and to be deflected outwardly into subterranean formation 11. Ram collar 15 is rigidly affixed to pipe string 16 which extends to the surface. The diameter of pipe string 16 is such that it will slideably fit within base pipe 13. By applying a downward force on pipe string 16, ram collar 15 will come in contact with the upper end of rod-like members 10 to thereby force them downwardly into contact with deflector collar 12 and thereby cause them to bend outwardly and to be forced radially outwardly into subterranean formation 11. By raising and lowering pipe string 16, a ramming or hammering action due to the weight of pipe string 16, as well as any additional force that may be applied by hammering and the like, will create sufficient force to cause rod-like members 10 to be driven outwardly in a radial direction as illustrated.

To facilitate the driving of rod-like members 10 into contact with subterranean formation 11, it may be desirable to equip the lower ends of rod-like members 10 with sharp points as illustrated. Rod-like members 10 can be of a solid metal construction or they can be tubular, so long as the tube walls are sufficiently thick to withstand the hammering action of ram collar 15 and to withstand the driving force into subterranean formation 11.

Figure 3:
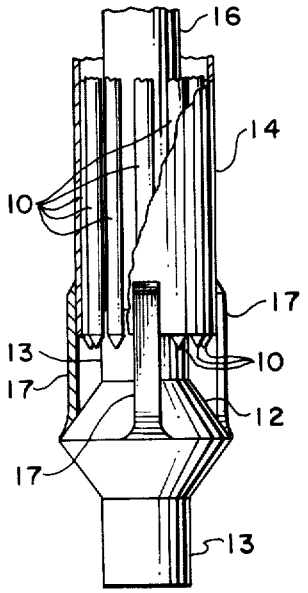
FIG. 3 is an elevational view of one of the preferred embodiments of this invention showing the improved apparatus as it is about to be installed in a well bore with a portion of the outer casing being removed.

FIG. 3 illustrates another embodiment of this invention wherein deflector collar 12 is affixed to outer casing 14 by means of welded connector rods 17. As illustrated in FIG. 3, a plurality of connector rods 17 are utilized to rigidly affix deflector collar 12 to outer casing 14 by welding the upper ends of connector rod 17 to the outer portions of outer casing 14 and the lower ends of connector rod 17 to deflector collar 12. As illustrated in FIG. 3, the apparatus is about to be lowered into a well bore and the plurality of rod-like members 10 are retracted into the annular space between outer casing 14 and pipe string 16. After the apparatus of FIG. 3 is lowered into the electrode well to a desired depth, the ram collar, which is affixed to the upper end of pipe string 16, can be utilized to force the lower ends of rod-like members 10 downwardly into contact with deflector collar 12 to thereby cause the plurality of rod-like members 10 to be radially forced outwardly into contact with the subterranean formation. By utilizing the apparatus illustrated in FIG. 3, it is not particularly necessary to cement the lower end of base pipe 13 into place. In some instances, the entire apparatus illustrated in FIG. 3 can be merely lowered into the bottom of a well bore that has been drilled into the subterranean formation and the hammering or forcing action can thereafter be carried out to drive the rod-like members into contact with the subterranean formation.

Figure 4:
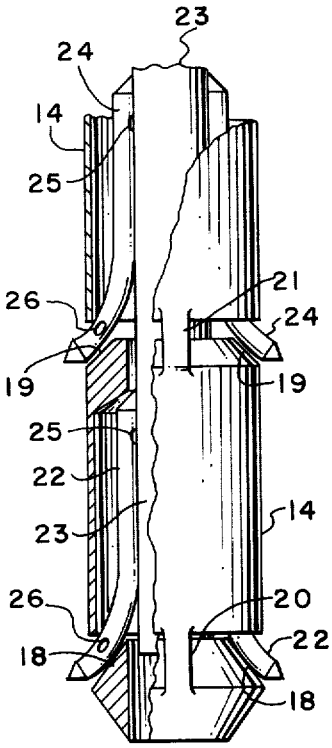
FIG. 4 is an elevational view of another preferred embodiment of this invention with a portion of the outer casing being removed to illustrate a plurality of rod-like members that can be disposed at different vertical levels within a subterranean formation.

FIG. 4 is another preferred embodiment of this invention that generally utilizes an outer casing 14 with a lower annular deflector 18 and an upper annular deflector 19. Lower annular deflector 18 is operably connected to outer casing 14 by means of a plurality of connecting rods 20 with the lower ends of connecting rods 20 being welded to lower annular deflector 18 and the upper ends of connecting rods 20 being welded to outer casing 14.

Upper annular deflector surface 19 can be similarly attached to the upper section of outer casing 14 by means of welded connector rods 21.

A plurality of lower rod-like members 22 can be affixed to inner pipe string 23 by welding or otherwise affixing the upper ends of lower rod-like members 22 to the outer surface of pipe string 23. The lower ends of rod-like members 22 are free to ride across lower annular deflector 18 and thus bend outwardly to be driven radially outwardly into the subterranean formation as pipe string 23 is forced downwardly. It should be noted that the lower end of pipe string 3 is of such a diameter that it will telescope within the central annular portion of lower annular deflector 18, as illustrated in FIG. 4. Thus, by applying a proper amount of force from above, inner pipe string 23 will move downwardly to thereby force the lower ends of the plurality of lower rod-like members 22 outwardly into the subterranean formation, as illustrated in FIG. 5.

In a manner similar to that discussed above for lower rod-like members 22, upper rod-like members 24 can also be affixed to inner pipe string 23 at their upper ends by welding or other suitable attachment. Upper deflector 19 is sized such that pipe string 23 will telescope within the central portion of the upper deflector 19. The lower ends of upper rod-like members 24 are adapted to slide across upper annular deflector 19 and to be bent outwardly and to radially extend outwardly into the subterranean formation as inner string 23 is forced downwardly.

Figure 5:
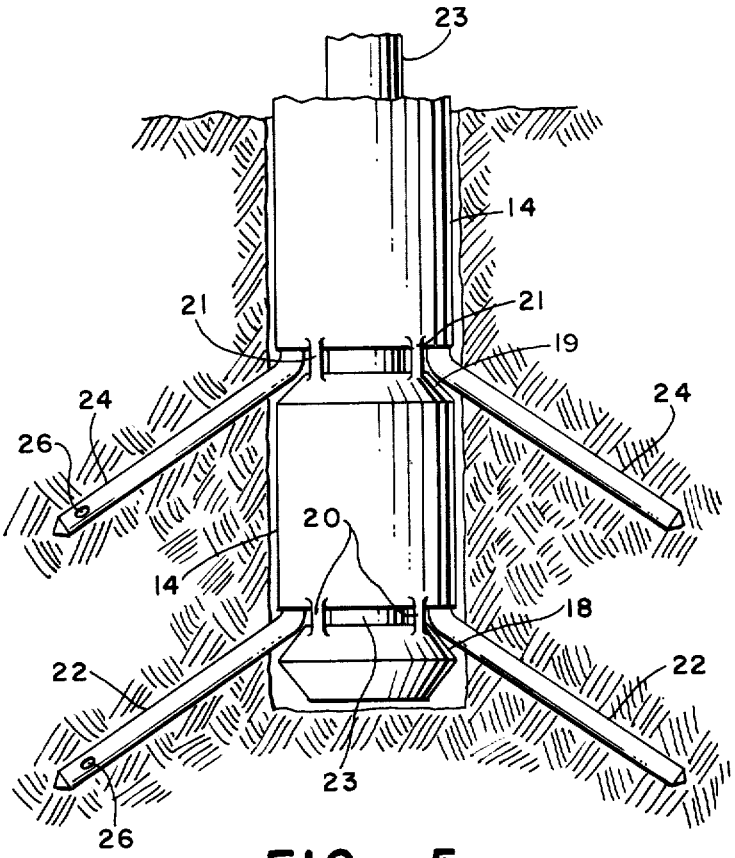
FIG. 5 is an elevational view of the apparatus of FIG. 4 as it is installed in a subterranean formation.

As illustrated in FIGS. 4 and 5, the apparatus therein provides for a plurality of rod-like electrical conductors to be disposed at different vertical levels within a subterranean formation. While only two such levels are illustrated, it will be appreciated that multiple levels of rod-like electrical conductors can extend outwardly into the subterranean formation to further increase the area of contact between the electrical conductors and the subterranean formations.

Figure 2:
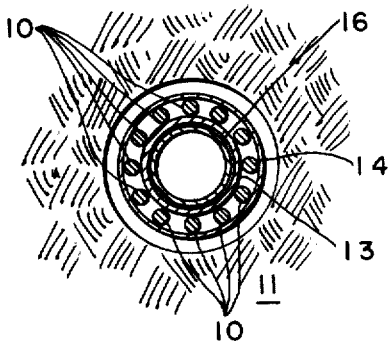
FIG. 2 is a sectional view taken along lines 2—2 in FIG. 1.

In operation, rod-like conductors 10 in FIGS. 1, 2 and 3, and rod-like conductors 22 and 24 in FIGS. 4 and 5, are electrically connected to a suitable source of electrical current. Any suitable means for connecting these conductors to the electric current source can be utilized. In some instances, it may be desired to fill the entire inner portion of casing 14 with an electrolyte, such as a brine solution and thereafter conduct the electrical current through the brine solution with the current flowing from the brine solution into the electrically conductive rod members. In some instances, it may be desirable to drill holes along the length of the tubular rod-like conductors to allow brine or other suitable electrolytes to flow into the subterranean formation in the vicinity of the rod-like members to further increase the current flow from the source of the electric current into the formation. In instances where electrolyte is added to the apparatus of this invention, the tubular rod-like members will normally have apertures in at least the upper portion thereof whereby electrolyte injected into the central well bore can enter the hollow core of the rod-like members. It has been found that an electrolyte, such as a brine solution, aids in the dissipation of heat from the area of high current flow adjacent the electrode. In some instances, it may be desirable to circulate brine or other type of electrolyte through the well bore and rod-like members to further improve heat dissipation. As shown in FIG. 4, apertures 25 in the upper portion of the rod-like members allow electrolyte to enter the central portion the tubular members and apertures 26 allow the electrolyte to exit into the formation to increase electrical conductivity and heat dissipation.

It will be appreciated that the foregoing improved electrode means vastly increase the area of contact between the electrodes and the subterranean formations through which current flows. The rod-like members extending outwardly from the well bore present a much larger effective well radius for the electric current to move through the subterranean formation. By producing the much larger effective well radius and much larger areas of contact, a given amount of electric current can be passed through the electrodes without undue heating in the vicinity of the electrode because the current density is much less than would be experienced if only a small conventional electrode was used. By thus utilizing the larger, more efficient electrodes of this invention, there will be a more even heating of the subterranean formation.

While the foregoing discussion has been directed toward only a few of the preferred embodiments of this invention, it should also be appreciated that various changes and modifications can be made in the illustrated equipment to still achieve the desired result. For example, any suitable means for forcing the elongated rod-like members downwardly to drive them outwardly into the subterranean formation. In its simplest form, the means for driving the elongated rod-like members outwardly can be a simple ram that is lowered into the outer casing and will contact the upper ends of the elongated rod-like members.

The length of the various elongated rod-like members and the distance that they are driven outwardly into the subterranean formation is a matter of choice. However, in a conventional tar sand formation, the elongated rod-like members can be as long as 30 feet or more and can be driven outwardly to form a large, effective radius of the electrode to thereby increase the efficiency of passing the electrical current through the formation without overheating. The diameter of the elongated rod-like members is also a matter of choice; however, elongated, rod-like members having an outside diameter of from about one-half to about three inches are quite effective and will have sufficient strength whereby they can be driven outwardly into the subterranean formations. Because of the deformable or bendable properties of the elongated rod-like members, it is also quite likely that the rod-like members may be deflected off or glanced off relatively hard deposits such as a rock-like underburden in the area of the subterranean formation into which they are being driven. With the deformable or bendable characteristics of the elongated rod-like members, such a deflection off hard deposits within the subterranean formation will not materially affect the efficiency of the rods.

The number of elongated rod-like members that are utilized in the apparatus of this invention is also a matter of choice. However, it will be appreciated that as the number of rod-like members are increased in the individual electrode assemblies, there will be a corresponding increase in the surface area of the electrode.

As previously mentioned, the instant invention is applicable for electrically heating subterranean formations such as tar sands and the like. The instant improved electrodes can be positioned adjacent the subterranean formations to be heated in conventional bore holes and can be used in conjunction with conventional injection and production wells, as well as satellite electrodes, to provide even, efficient, electrical heating of subterranean formations. In carrying out the method of this invention, the plurality of rod-like members will normally be positioned adjacent the formation to be ultimately heated in a near vertical configuration in a conventional bore hole and force will be applied to drive the lower ends of the rod-like members radially outwardly from the axis of the bore hole.

Various improvements and modifications may be made in the foregoing disclosure without departing from the spirit and scope of this invention.

I claim:

1. An electrode apparatus for passing a current through a subterranean formation which comprises:

(a) an outer, elongated, cylindrical casing adapted to lowered into a well bore;

(b) a deflector means secured to the lower portion of said outer, elongated, cylindrical casing;

(c) a smaller diameter inner pipe string concentrically positioned within said outer, elongated cylindrical casing, said inner pipe string being adapted to move vertically within said outer, elongated cylindrical casing;

(d) a plurality of elongated, rod-like members having upper and lower ends positioned vertically in the annular space between said outer elongated, cylindrical casing and said inner pipe string; and (e) an annular ram collar rigidly affixed to the outer surfaces of said inner pipe string, said ram collar being sized to allow vertical movement within said outer, elongated, cylindrical casing whereby downward movement of said inner pipe string will cause said annular ram collar to engage and strike the upper ends of said elongated, rod-like members, thereby driving said rod-like members downwardly into contact with said deflector means to deflect and direct the lower ends of said rod-like members outwardly from said well bore into said formation.

2. The apparatus of claim 1 wherein said rod-like members are deformable and are adapted to bend outwardly across said deflector means as downward force is applied to the upper ends of said rod-like members.

3. The apparatus of claim 2 wherein said rod-like members are tubular with apertures extending through the walls of said members adjacent the upper and lower ends of said members.

4. The apparatus of claim 3 wherein means to inject an electrolyte into said tubular rod-like means are included.

5. An improved method for passing an electrical current through a subterranean formation comprising the steps of:

(a) drilling a well bore into said formation;

(b) securing a deflector means to the lower end of an outer, elongated, cylindrical casing;

(c) placing a plurality of elongated, rod-like members having upper and lower ends vertically inside said outer, elongated, cylindrical casing;

(d) placing a smaller diameter inner pipe string concentrically within said outer, elongated cylindrical casing whereby said plurality of elongated rod-like members are positioned in the annular space between the interior of said outer elongated cylindrical casing and said inner pipe string, said inner pipe string having an annular ram collar affixed to the outer surfaces of said inner pipe string, said ram collar being sized to allow vertical movement of said inner pipe string within said outer, elongated, cylindrical casing;

(e) positioning said outer, elongated, cylindrical casing, containing said plurality of said elongated rod-like members and said inner pipe string into said well bore adjacent said subterranean formation;

(f) moving said inner pipe string downwardly whereby said annular ram collar engages the upper ends of said elongated, rod-like members to thereby force the lower ends of said elongated, rod-like members downwardly into contact with said deflector means to cause said rod-like members to be forced outwardly into said subterranean formation; and (g) establishing an electrical current through said rod-like members whereby said electrical current passes through said formation.

6. The method of claim 5 wherein an electrolyte is circulated through said rod-like members and into contact with said subterranean formation.

* * * * *